US012029248B2

(12) United States Patent
Asmus et al.

(10) Patent No.: US 12,029,248 B2
(45) Date of Patent: Jul. 9, 2024

(54) HEATING ELEMENT FOR A SYSTEM FOR PROVIDING AN INHALABLE AEROSOL

(71) Applicant: Heraeus Nexensos GmbH, Kleinostheim (DE)

(72) Inventors: Tim Asmus, Kleinostheim (DE); Stefan Dietmann, Kleinostheim (DE); Matthias Muziol, Kleinostheim (DE); Karlheinz Wienand, Aschaffenburg (DE)

(73) Assignee: Heraeus Nexensos GmbH, Kleinostheim (DE)

( * ) Notice: Subject to any disclaimer, the term of this patent is extended or adjusted under 35 U.S.C. 154(b) by 701 days.

(21) Appl. No.: 17/279,160

(22) PCT Filed: Sep. 13, 2019

(86) PCT No.: PCT/EP2019/074487
§ 371 (c)(1),
(2) Date: Mar. 24, 2021

(87) PCT Pub. No.: WO2020/064365
PCT Pub. Date: Apr. 2, 2020

(65) Prior Publication Data

US 2021/0392955 A1 Dec. 23, 2021

(30) Foreign Application Priority Data

Sep. 24, 2018 (EP) ..... 18196175

(51) Int. Cl.
*A24F 40/46* (2020.01)
*A24F 40/70* (2020.01)

(52) U.S. Cl.
CPC ..... *A24F 40/46* (2020.01); *A24F 40/70* (2020.01)

(58) Field of Classification Search
CPC ..... A24F 40/46; A24F 40/70; A24F 40/20; A24F 40/51; H05B 3/44; H05B 1/0227;
(Continued)

(56) References Cited

U.S. PATENT DOCUMENTS 5,665,262 A 9/1997 Hajaligol et al.
6,222,166 B1 4/2001 Lin et al.
(Continued)

FOREIGN PATENT DOCUMENTS

AU 2014314050 A1 * 12/2015 ..... A24B 15/165
CN 108451046 8/2018
(Continued)

OTHER PUBLICATIONS

Written Opinion and International Search Report dated Nov. 15, 2019 in PCT/EP2019/074487.

*Primary Examiner* — Jean F Duverne
(74) *Attorney, Agent, or Firm* — Dicke, Billig & Czaja, PLLC

(57) ABSTRACT

One aspect is a heating element for a system for providing an inhalable aerosol, including a base body with an electrically insulating material, a heating structure arranged on the base body, and a cover layer adapted to fix the heating structure on the base body. One aspect further relates to a method for producing a heating element for a system for providing an inhalable aerosol, to a system for providing an inhalable aerosol, and to a vaporizer unit for such a system.

17 Claims, 2 Drawing Sheets

Figure 1:
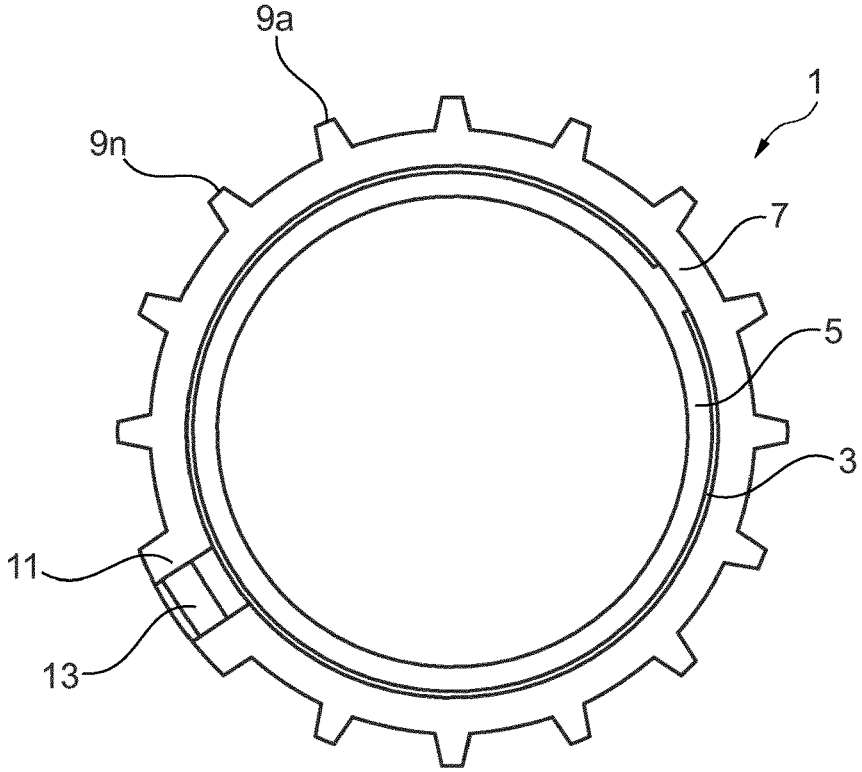

(58) Field of Classification Search
CPC ..... H05B 1/0291; B29C 45/00; B29D 23/00; C04B 2235/6022
See application file for complete search history.

(56) References Cited

U.S. PATENT DOCUMENTS

| | | | |
|---|---|---|---|
| 8,557,082 | B2 | 10/2013 | Privett et al. |
| 9,821,135 | B2 | 11/2017 | Tang et al. |
| 10,321,719 | B2 | 6/2019 | Peuchert et al. |
| 10,549,064 | B2 | 2/2020 | Tang et al. |
| 2009/0020905 | A1 | 1/2009 | Privett et al. |
| 2017/0215474 | A1 | 8/2017 | Li |
| 2017/0280777 | A1 | 10/2017 | Manca et al. |

FOREIGN PATENT DOCUMENTS

| | | | |
|---|---|---|---|
| DE | 10 2016 115 574 | | 4/2018 |
| EP | 2 316 286 | | 5/2011 |
| JP | 2010533980 | | 10/2010 |
| JP | 2013509160 | | 3/2013 |
| JP | 2014-216287 | | 11/2014 |
| KR | 20170021361 | A | 2/2017 |
| RU | 2607772 | C1 * | 1/2017 |
| WO | 2009/012239 | | 1/2009 |
| WO | 2009012239 | A2 | 1/2009 |
| WO | 2012/171072 | | 12/2012 |
| WO | 2012171072 | A1 | 12/2012 |

* cited by examiner

HEATING ELEMENT FOR A SYSTEM FOR PROVIDING AN INHALABLE AEROSOL

CROSS REFERENCE TO RELATED APPLICATION

This Utility Patent Application claims priority under 35 U.S.C. § 371 to International Application Serial No. PCT/EP2019/074487, filed Sep. 13, 2019, which claims the benefit of European Patent Application No. 18196175.6, filed Sep. 24, 2018; which are both incorporated herein by reference.

The present invention relates to a heating element and to a method for producing a heating element for a system for providing an inhalable aerosol. Furthermore, the present invention relates to a system for providing an inhalable aerosol and to a vaporizer unit for such a system.

Systems with heating elements for providing inhalable aerosols which heat a substance for forming the aerosol are known from the prior art. These systems are often referred to as electronic cigarettes or simply e-cigarettes. Typically, such systems comprise a mouthpiece and a vaporizer unit which comprises a heating element. Depending on the system used, the substance can comprise a nicotine-containing product such as tobacco or a tobacco-like product and they can be liquid, gaseous or solid. However, a nicotine-free substance can also be provided. The aerosol that forms can then be guided past a nicotine-containing body or a body with nicotine or flow through said body in order to add nicotine to the aerosol.

Moreover, in general, the substance is not burned like a conventional cigarette, but only heated to obtain the inhalable aerosol thereby. The heating element in the process heats the substance in a temperature range of approximately 200° C. to 400° C., so that the inhalable aerosol is produced, which can be inhaled by the user of the system.

Thus, for example, lance-, tube- or rod-shaped heating elements are known from the prior art. The substance for forming the aerosol is brought into contact with these heating elements.

For example, in U.S. Pat. No. 5,665,262A, a tubular heating element is described which is formed from a metal sleeve, an insulation layer on the metal sleeve and a resistance element applied thereon.

In JP2014216287A, a heating element is described which is formed from a thin aluminum tube with an oxidized surface. A heating wire is wound around the thin aluminum tube.

US20170215474A1 describes a tubular heating element with a perforated aluminum cylinder as thermal contact mediator between a NiCd heating wire which is wound around the aluminum cylinder. The tubular heating element is filled with the substance in order to form the aerosol.

In DE102016115574A1, a tubular heating element with a carrier material made of glass or a glass ceramic and with metallic heat conducting structures is described.

U.S. Pat. No. 6,222,166B1 describes a heating element made of a metal with a high thermal coefficient of expansion of >16×10E−16/° C.; for example, the material can be an aluminum material with a dielectric layer, for example, Al2O3, and a thick-layer resistance heater applied thereon.

However, the heating elements known from the prior art have the disadvantage that these heating elements can only be produced with increased production technological effort and that relatively expensive materials have to be used for the construction of the heating elements.

Therefore, the aim of the present invention is to provide an improved heating element and a method for producing such an improved heating element, which overcome the disadvantages of the prior art. In particular, the aim is to provide a heating element and a method by means of which a heating element can be produced inexpensively and simply.

This aim is achieved according to the invention by a method according to the subject matter of claim 1.

The heating element according to the invention for a system for providing an inhalable aerosol for this purpose comprises:

- a base body comprising an electrically insulating material;
- a heating structure arranged on the base body; and
- a cover layer adapted to fix the heating structure on the base body.

The base body ideally has a high temperature stability and a high thermal conductivity. Moreover, at least the surface of the base body comprises an insulating material with good electrically insulating properties. The electrically insulating material can comprise, for example, an aluminum oxide material, an anodized aluminum material, or a steel coated with glass slip, in particular a steel sleeve coated with glass slip.

The term "heating structure" can be understood to mean a heat resistance which is arranged on the base body and which, in its simplest design, comprises a metal wire also referred to as heat conductor. For example, the heating structure can also be designed in the form of a conducting track which, for example, runs in a meander. When a current flows through the conducting track, the intrinsic resistance of the conducting track generates heat. Depending on the current flowing through the conducting track, the heat power of the heating structure can be determined. The heating structure can be arranged on the outside of the base body.

The heating structure can be arranged, for example, by screen printing and/or tape casting or also as a free-standing structure on the base body.

The term "cover layer" can be understood to mean an electrically insulating layer such as, for example, a glass material, which is burned onto the base body and the heating structure. For example, the firing can occur at at least 850° C. for at least 1 hour.

Alternatively, the cover layer can also be an injection molded part made of temperature-resistant plastic, which is pressed onto the base body and the heating structure and which fixes the heating structure on the base body.

The invention is based on the surprising finding that a simple and inexpensive production of the heating element according to the invention can be achieved.

In one example, the base body is designed in the form of a tube.

For example, the tube can have a diameter of less than or equal to 20 mm and have a round, ellipsoid, triangular or multi-angular cross section. In this example, the heating structure and the cover layer are correspondingly designed in the form of a tube. The substance for forming the aerosol can be arranged, for example, in the middle of the tube.

In an additional example, the base body comprises an aluminum oxide material, an anodized aluminum material, or a steel coated with glass slip, in particular a steel sleeve coated with glass slip.

A base body made of an aluminum oxide material or an anodized aluminum material offers an inexpensive starting material with very good thermal properties. Alternatively, a base body made of steel can also be provided, which is coated with glass slip.

In one example, the base body comprises:

a sleeve, or an anodized aluminum foil, preferably having a thickness of 0.1 to 0.7 mm, wherein the anodized aluminum foil with heating structure arranged thereon is rolled up in the form of a sleeve, in particular with an outer diameter of 5 to 15 mm, or a fired aluminum oxide material or a ceramic injection molded part.

The sleeve can have, for example, an outer diameter of 5 to 15 mm and a wall thickness of 0.1 to 0.7 mm. The anodized aluminum foil can be rolled up in such a way that the abutting edges of the foil are connected to one another, for example welded, so that a closed sleeve is formed. In an alternative example, the abutting edges are not connected and remain open. In yet another example, the foil can overlap at its abutting edges and/or be wound up in multiple windings.

In another example, the heating structure:

is printed, vapor-deposited, applied as a photostructurable paste on the base body, or arranged as a structured metal foil on the base body.

For example, the heating structure can be arranged particularly quickly and efficiently on the base body by sieve printing and/or tape casting.

Alternatively, the heating structure can be introduced as a conducting track into a metal foil, and the correspondingly structured metal foil in turn can be arranged on the base body and held by the cover layer.

In this example, the structured metal foil can have a meander and at least one partial surface of a conducting track of the meander has a curvature which corresponds to a curvature of an outer diameter of the base body.

Advantageously, as a result of such a configuration, the structured metal foil can act like a leaf spring and thus improve the thermal contact with the base body.

In an additional example, the cover layer comprises:

a baked glass layer, or an injection molded part made of temperature-resistant plastic, in particular comprising a PEEK, PPS or PTFE material; preferably, the injection molded part is pressed onto the base body and the heating structure.

Due to the fixation with the injection molded part, the heating element can be produced particularly simply and inexpensively, since the baking of the cover layer can be dispensed with.

In another example, the heating element comprises at least one temperature sensor, arranged on the heating structure, preferably two temperature sensors, in particular a PT1000 with two feed lines, wherein the feed lines are arranged as flat ribbon feed lines or wire feed lines, and wherein the feed lines are arranged axially or parallel to one another and comprise at least a platinum material, a nickel material, an iron material, a copper material or a brass material; preferably the feed lines are coated with gold, silver or platinum, and wherein the cover layer comprises a sheath for the temperature sensor.

The temperature sensor can be connected, for example, to evaluation electronics and transmit the instantaneous temperature of the heating structure to the evaluation electronics.

Advantageously, the temperature sensor with flat feed lines described in the example allows a particularly space-saving arrangement. Also advantageously, the sheath in the cover layer allows a good fixation of the temperature sensor on the heating structure as well as a good thermal shielding from the outside. In this context the term "sheath" can be understood to mean a recess in the cover layer which at least partially surrounds the outer geometry of the temperature sensor.

In one example, the heating structure comprises a structured steel alloy, a nickel-iron alloy or a nickel-chromium alloy, in particular with a resistance of 0.4 to 3 ohm, preferably 0.6 ohm.

Advantageously, by selecting a steel alloy for the heating structure, a particularly appropriate heating element can be produced.

The invention also proposes a method for producing a heating element for a system for providing an inhalable aerosol, comprising the successive steps:

providing a base body comprising an electrically insulating material;

arranging a heating structure on the base body; and arranging a cover layer adapted to fix the heating structure on the base body.

In one example, providing the base body comprises:

providing a tubular base body, and/or providing a base body comprising an aluminum oxide material, an anodized aluminum material, or a steel coated with glass slip, in particular a steel sleeve coated with glass slip.

In another example, providing the base body comprises:

providing the base body as a sleeve and arranging the heating structure on the base body, providing the base body as an anodized aluminum foil and rolling up the base body with heating structure arranged thereon in the form of a sleeve, with an outer diameter of 5 to 15 mm, or providing the base body as a green body, in particular as a ceramic injection molded part, comprising an aluminum oxide material and firing the green body.

In one example, arranging the heating structure comprises:

printing the heating structure by screen or pad printing of a metal paste onto the base body and baking the metal paste, or arranging a metal layer by vapor deposition or dip coating on the base body and structuring with a laser ablation process, or vapor-depositing the heating structure, or applying it as photostructurable paste and structuring with a photolithography process, or arranging the heating structure as structured metal foil on the base body.

In another example, arranging the cover layer comprises:

baking a glass layer onto the base body and heating structure, or arranging an injection molded part made of temperature-resistant plastic, in particular a PEEK, a PPS or a PTFE material, preferably pressing the injection molded part onto the base body and the heating structure and/or the temperature sensor.

The invention also proposes a vaporizer unit for a system for providing an inhalable aerosol, comprising a heating element according to the invention and/or a heating element produced by a method according to the invention.

Furthermore, the invention proposes a system for providing an inhalable aerosol, comprising a heating element according to the invention and/or a heating element produced by a method according to the invention.

Additional features and advantages of the invention result from the following description, in which preferred embodiments of the invention are explained with the aid of diagrammatic drawings.

Figure 2:
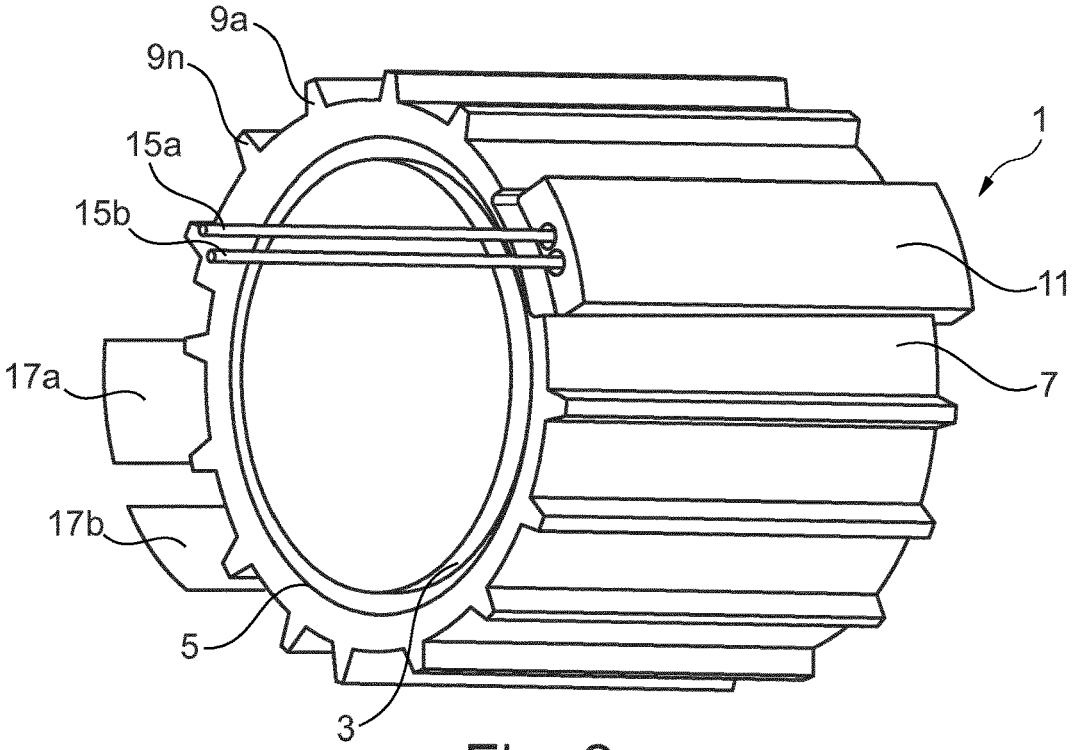
Figure 3:
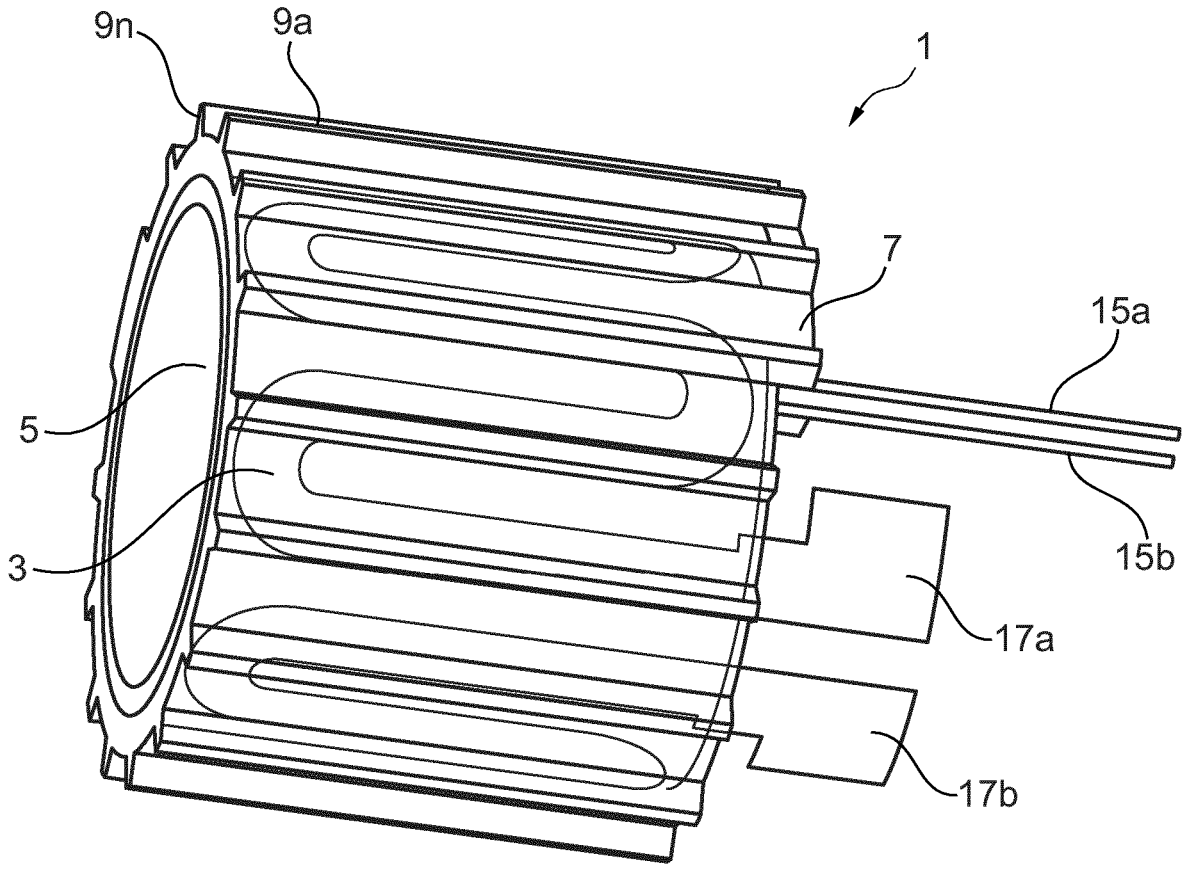

In the Drawings:

FIG. 1 shows a diagrammatic cross-sectional view of a heater according to embodiments of the invention; and FIGS. 2 and 3 show isometric views of a heater according to embodiments of the invention.

The heating element 1 shown in FIGS. 1 to 3, for a system for providing an inhalable aerosol, comprises a tubular base body 5 with an electrically insulating material, a heating structure 3 arranged on the base body 5 and a cover layer 7 adapted so as to fix the heating structure 3 on the base body 5. As shown in the figures, the heating structure 3 is arranged on the outside of the base body 5. The substance for forming the aerosol can be arranged in the interior of the tubular base body 5. Furthermore, FIG. 1 shows rod-shaped heat sinks 9*a*-9*n* which are arranged around the outer circumference of the cover layer 7. However, the person skilled in the art knows that these heat sinks 9*a*-9*n* are not essential for the invention.

FIG. 1 also shows a temperature sensor 13 arranged on the heating structure 3, and a sheath 11 in the cover layer 7 in order to fix the temperature sensor 13 to or on the heating structure 3.

In a first embodiment, the base body 5 shown can be an anodized aluminum tube with an outer diameter of 5-15 mm and a wall thickness of 0.1-0.7 mm. The aluminum oxide layer has a thickness of 5-50 μm and serves as electrically insulating substrate. The heating structure 3 can be applied to the anodized aluminum tube by:

a)screen printing or pad printing of a metal paste and subsequent baking, b)application of a metal layer over the entire surface, for example by vapor deposition, dip coating and subsequent laser structuring, c)photostructurable pastes, in particular thin-layer pastes (dipping, spraying) and subsequent structuring via a photolithography process, or d)pressing/gluing a structured metal foil, for example, punched out.

In FIG. 3, the cover layer 7 is represented as transparent in order to reveal the underlying heating structure 3. In FIG. 3, the heating structure 3 shown is designed with a meander and comprises two connection contacts 17*a*, 17*b* which are contacted by means of feed wires (not shown).

In an embodiment not shown, the base body 5 can extend over the connection contacts 17*a*, 17*b* and over the feed lines 15*a*, 15*b* of the temperature sensor 13.

In a second embodiment, an aluminum foil can also be used as base body 5, instead of the above-described anodized aluminum tube. For example, an aluminum foil with a thickness of 0.1-0.7 mm can be cut into strips and subsequently anodized. The aluminum oxide layer can have a thickness of 5-50 μm. The heating structure 3 can be applied onto the anodized aluminum strips as described above in the first embodiment.

After the application of the heating structure 3, the foil can be rolled up so that a sleeve with an outer diameter of 5-15 mm is formed. The abutting edges of the foil can be connected to one another, for example, welded together, so that a closed sleeve is formed. Alternatively, it is possible for the abutting edges not to be connected and to remain open. However, in an embodiment not shown, the foil can also overlap at its abutting edges. The winding can also occur in the form of multiple turns, in particular so that the heating structure 3 is covered by a foil winding.

In a third embodiment, as base body 5, a green body made of aluminum oxide can be provided and extruded in the form of a tube and then divided into individual pieces with the desired length and fired. Alternatively, the green body can also be produced as a ceramic injection molded part.

In a fourth embodiment, a steel sleeve can be coated with a cover layer 7 made of glass slip and then fired.

In a fifth embodiment, an aluminum sleeve or alternatively an aluminum (alloy) sleeve anodized up to approximately 15 μm or hard-anodized up to approximately 25 μm can be provided. The heating structure 3 can be an eroded steel alloy 42, a NiCr alloy or a similar material with an electrical resistance of 0.4-3 ohm, typically 0.6 ohm.

All the additional machining steps of embodiments two to five can correspond to those of the first embodiment.

The features represented in the above description, in the claims and in the figures, both individually and also in any combination, can be essential to the invention in its different embodiments.

LIST OF REFERENCE NUMERALS

1 Heating element
3 Heating structure
5 Base body
7 Cover layer
9*a*-9*n* Heat sink
11 Sheath
13 Temperature sensor
15*a*, 15*b* Feed lines
17*a*, 17*b* Connection contacts

The invention claimed is:

1. A heating element for a system for providing an inhalable aerosol, comprising:

a base body comprising an electrically insulating material;

a heating structure arranged on the base body;

a cover layer adapted to fix the heating structure on the base body; and a PT1000 temperature sensor with two feed lines arranged on the heating structure;

wherein the feed lines are flat ribbon feed lines or wire feed lines;

wherein the feed lines are arranged axially or parallel to one another and comprise at least a platinum material, a nickel material, an iron material, a copper material or a brass material, the feed lines being coated with gold, silver or platinum, and wherein the cover layer comprises a sheath for the temperature sensor.

2. The heating element according to claim 1, wherein the base body is tubular.

3. The heating element according to claim 1, wherein the base body comprises an aluminum oxide material, an anodized aluminum material, a steel coated with glass slip, or a steel sleeve coated with glass slip.

4. The heating element according to claim 1, wherein the base body comprises a sleeve.

5. The heating element according to claim 1, wherein the base body comprises an anodized aluminum foil, having a thickness of 0.1 to 0.7 mm, wherein the anodized aluminum foil with the heating structure arranged thereon is rolled up in the form of a sleeve with an outer diameter of 5 to 15 mm.

6. The heating element according to claim 1, wherein the base body comprises a fired aluminum oxide material or a ceramic injection molded part.

7. The heating element according to claim 1, wherein the heating structure is printed, vapor-deposited, applied as a photostructurable paste on the base body, or is arranged as a structured metal foil on the base body.

8. The heating element according to claim 7, wherein the structured metal foil comprises a meander, and at least one partial surface of a conducting track of the meander has a curvature which corresponds to a curvature of an outer diameter of the base body.

9. The heating element according to claim 1, wherein the cover layer:

comprises a baked glass layer, or an injection molded part made of temperature-resistant plastic comprising a PEEK, PPS or PTFE material, the injection molded part being pressed onto the base body and the heating structure.

10. A method for producing a heating element for a system for providing an inhalable aerosol, comprising the successive steps:

providing a base body comprising an electrically insulating material;

arranging a heating structure on the base body; and arranging a cover layer adapted to fix the heating structure on the base body, wherein arranging the heating structure comprises:

printing the heating structure by screen or pad printing of a metal paste onto the base body and baking the metal paste, or arranging a metal layer by vapor deposition or dip coating on the base body and structuring with a laser ablation process, or vapor-depositing the heating structure, or applying if as photostructurable paste and structuring with a photolithography process, or arranging the heating structure as structured metal foil on the base body.

11. The method according to claim 10, wherein providing the base body comprises:

providing a tubular base body, and/or providing a base body comprising an aluminum oxide material, an anodized aluminum material, or a steel coated with glass slip, in particular a steel sleeve coated with glass slip.

12. The method according to claim 10, wherein providing the base body comprises:

providing the base body as a sleeve and arranging the heating structure on the base body, providing the base body as an anodized aluminum foil and rolling up the base body with heating structure arranged thereon in the form of a sleeve, with an outer diameter of 5 to 15 mm, or providing the base body as a green body, in particular as a ceramic injection molded part, comprising an aluminum oxide material and firing the green body.

13. The method according to claim 10, wherein providing the base body comprises:

providing a tubular base body, and/or providing a base body comprising an aluminum oxide material, an anodized aluminum material, or a steel coated with glass slip, in particular a steel sleeve coated with glass slip.

14. The method according to claim 10, wherein providing the base body comprises:

providing the base body as a sleeve and arranging the heating structure on the base body, providing the base body as an anodized aluminum foil and rolling up the base body with heating structure arranged thereon in the form of a sleeve, with an outer diameter of 5 to 15 mm, or providing the base body as a green body, in particular as a ceramic injection molded part, comprising an aluminum oxide material and firing the green body.

15. A method for producing a heating element for a system for providing an inhalable aerosol, comprising the successive steps:

providing a base body comprising electrically insulating material;

arranging a heating structure on the base body; and arranging a cover layer adapted to fix the heating structure on the base body, wherein arranging the cover layer comprises:

baking a glass layer onto the base body and heating structure, or arranging an injection molded part made of temperature-resistant plastic comprising a PEEK, a PPS or a PTFE material, and pressing the injection molded part onto the base body and the heating structure and/or the temperature sensor.

16. A heater for a vaporizer unit for a system for providing an inhalable aerosol, comprising a heating element, the heating element comprising:

a base body comprising an electrically insulating material;

a heating structure arranged on the base body;

a cover layer adapted to fix the heating structure on the base body; and a PT1000 temperature sensor with two feed lines arranged on the heating structure;

wherein the feed lines are flat ribbon feed lines or wire feed lines;

wherein the feed lines are arranged axially or parallel to one another and comprise at least a platinum material, a nickel material, a copper material or a brass material, the feed lines being coated with gold, silver or platinum, and wherein the cover layer comprises sheath for the temperature sensor.

17. A system for providing an inhalable aerosol, comprising a heating element, the heating element comprising:

a base body comprising an insulating material;

a heating structure arranged on the base body;

a cover layer adapted to fix the heating structure on the base body; and a PT1000 temperature sensor with two feed lines arranged on the heating structure;

wherein the feed lines are flat ribbon feed lines or wire feed lines;

wherein the feed lines are arranged axially or parallel to one another and comprise at least a platinum material, a nickel material, an iron material, a copper material or a bras material, the feed lines being coated with gold, silver or platinum, and wherein the cover layer comprises a sheath for the temperature sensor.

* * * * *